US011974627B2

(12) United States Patent
Walker et al.

(10) Patent No.: US 11,974,627 B2
(45) Date of Patent: May 7, 2024

(54) APPARATUS, METHODS AND WEARABLE DEVICES FOR DELIVERING COOLED FILTERED AIR FOR BREATHING TO USERS THEREOF

(71) Applicants: John Walker, Saint-Lambert (CA); Daniel Ringuette, Saint-Hubert (CA)

(72) Inventors: John Walker, Saint-Lambert (CA); Daniel Ringuette, Saint-Hubert (CA)

( * ) Notice: Subject to any disclaimer, the term of this patent is extended or adjusted under 35 U.S.C. 154(b) by 0 days.

(21) Appl. No.: 17/676,067

(22) Filed: Feb. 18, 2022

(65) Prior Publication Data

US 2022/0264986 A1 Aug. 25, 2022

Related U.S. Application Data

(60) Provisional application No. 63/150,699, filed on Feb. 18, 2021.

(51) Int. Cl.
*A42C 5/04* (2006.01)
*A42B 1/008* (2021.01)

(52) U.S. Cl.
CPC ..... *A42C 5/04* (2013.01); *A42B 1/008* (2013.01)

(58) Field of Classification Search
CPC ..... A42B 1/008; A42B 3/28; A42B 3/281; A42B 3/283; A42B 3/286; A42B 3/288; A42C 5/04; A62B 18/003; A62B 18/006; Y10S 2/906
See application file for complete search history.

(56) References Cited

U.S. PATENT DOCUMENTS 2,032,101 A * 2/1936 Sullivan ..... A62B 18/003 2/9
2,560,215 A * 7/1951 Christensen ..... A62B 18/003 128/200.28
3,391,407 A * 7/1968 Waters ..... A42B 3/286 2/7
3,813,696 A * 6/1974 Yeager ..... A42B 3/286 416/63
3,822,698 A * 7/1974 Guy ..... A42B 3/286 128/201.25
3,881,198 A * 5/1975 Waters ..... A42B 3/286 2/906
4,238,857 A * 12/1980 Waters ..... A42B 1/008 2/906
4,744,106 A * 5/1988 Wang ..... A42B 3/286 D29/103
RE33,286 E * 8/1990 Waters ..... A42C 5/04 351/158
5,054,480 A * 10/1991 Bare ..... A41D 13/11 128/206.28
5,085,231 A * 2/1992 Johnson ..... A42C 5/04 131/331
5,113,853 A * 5/1992 Dickey ..... A62B 18/045 128/201.24
6,122,773 A * 9/2000 Katz ..... A42B 3/286 2/422
6,370,695 B2 * 4/2002 Paris ..... A41D 13/11 2/202

(Continued)

*Primary Examiner* — F Griffin Hall
(74) *Attorney, Agent, or Firm* — Newman Law, LLC

(57) ABSTRACT

An apparatus and method for providing cooled clean filtered air to the wearer of this device while allowing them to remain inconspicuous and to do so using inexpensive easily obtainable filtration supplies.

14 Claims, 7 Drawing Sheets

(56) References Cited

U.S. PATENT DOCUMENTS

| | | | | |
|---|---|---|---|---|
| 6,481,019 | B2 * | 11/2002 | Diaz | A41D 13/11 128/201.19 |
| 6,751,807 | B2 * | 6/2004 | Klotz | A42B 3/286 2/171.3 |
| 6,990,691 | B2 * | 1/2006 | Klotz | A42B 3/286 2/901 |
| 7,143,451 | B2 * | 12/2006 | Lundgren | A42C 5/04 2/209.13 |
| 7,752,682 | B2 * | 7/2010 | VanDerWoude | A41D 13/11 2/410 |
| 7,921,473 | B1 * | 4/2011 | Winters | A42B 3/286 2/209.13 |
| 8,136,169 | B2 * | 3/2012 | Taylor | A42B 1/008 2/171.3 |
| 8,667,960 | B2 * | 3/2014 | Ausen | A62B 18/045 128/201.25 |
| 9,358,409 | B2 * | 6/2016 | Ausen | A62B 18/045 |
| 9,360,016 | B2 * | 6/2016 | Hamilton | A42B 3/286 |
| 9,474,315 | B2 * | 10/2016 | Lee | A42B 1/008 |
| 9,756,888 | B2 * | 9/2017 | Ku | A42B 1/008 |
| 11,272,753 | B2 * | 3/2022 | Murphy | F04D 25/084 |
| 11,684,691 | B2 * | 6/2023 | Tillmanns | G02C 5/001 250/454.11 |
| 2013/0118506 | A1 * | 5/2013 | Osipov | A41D 13/1184 128/858 |
| 2015/0143613 | A1 * | 5/2015 | Chu | A42B 3/286 2/171.3 |
| 2016/0255901 | A1 * | 9/2016 | Jeon | A42B 3/286 |
| 2017/0361133 | A1 * | 12/2017 | Yu | A62B 18/006 |
| 2021/0353969 | A1 * | 11/2021 | Leschinsky | A62B 9/00 |
| 2021/0378346 | A1 * | 12/2021 | Abghari | A61F 9/045 |
| 2022/0047036 | A1 * | 2/2022 | Kurmlavage | A42B 1/017 |
| 2022/0053869 | A1 * | 2/2022 | Colgan | A42B 3/286 |

* cited by examiner

APPARATUS, METHODS AND WEARABLE DEVICES FOR DELIVERING COOLED FILTERED AIR FOR BREATHING TO USERS THEREOF

BACKGROUND OF THE INVENTION

Field of the Invention

This invention is generally concerned with apparatus and methods for providing cooled fresh clean filtered air to the wearer.

Background of the Art

The need exists today for people to protect themselves from the risk of becoming infected from air-born viral and bacterial aerosol laden droplets that can lead to sickness. Normally when people or animals are sick with lung-based infection, they often shed these bacterial and viral droplets which are microscopic in size within substantially huge droplets of saliva that become airborne. In fact, there can be millions or even billions of these within a single droplet. The scale difference is comparable to humans on planet earth with the earth being the droplets and the people being the virus.

This risk is normally mitigated through the wearing of simple surgical or N95 type rated mask. Mask technology has inherent drawbacks that make it less than ideal in preventing infection and subsequent sickness. These drawbacks include physical issues such as there being a differential pressure on each side of these N95 masks. This differential pressure gradient is due to the many fine filtration layers of material in these masks that make continual wearing tiring and stressful for the wearer. Also, there is a substantial amount of physical effort required to fill one's lungs even without this differential pressure. This is a serious problem for those who may be wearing these type masks for up to 12 hours continuously each day.

These issues most definitely increase the stress on the wearer and stress is often tied to weaking our immune systems further increasing the risk of contagion. Moreover, the process of exhaling warm moist air into the area where you are filtering, and inhaling tends to create moisture buildup issues that lead to significant problems for those wearing the device. Including the risk of bacterial lung infection caused by exhaling and inhaling this warm moist air within the interior surface of the mask. This is not trivial and has in some cases lead to major health issues for some people especially those in the medical profession such as doctors, nurses, and dentists.

Another major issue occurs with the use of simple surgical masks which are the most widely used today. It must be noted that this type of simple mask does not have the issue of backpressure described above as with the N95. For this reason, these inexpensive masks are preferred by most people. In fact, it is likely chosen more than 100:1 over N95 but hides its largest drawback, which is its false sense of security.

For example, the area around the nose of most simple surgical masks is almost always not tightly bound to the face. More specifically the metal comfort strip to help keep the mask tightly sealed to the face is less than ideal and often not formed properly by the user. Air will always choose the path of least resistance and tend to enter at the nose bridge just below the eyes rendering the mask all but useless since this is unfiltered air, a fact that people who wear glasses are keenly aware of. Those of us who wear glasses often deal with fogging when exhaling which proves that this is the area with the path of least resistance, that is, air exits the nose bridge and travels up to fog our glasses. In fact, a false sense of security with these type masks may be one of the reasons that the recent pandemic propagated.

Consistent with both the N95 and surgical masks is the issue of eating and drinking. Areas such as restaurants, sporting facilities and air travel involves eating and drinking. It is next to impossible to eat and drink with a mask on, so a loophole exists in these locations' health officials permit removal of the mask provided you are seated and are eating or drinking. It remains that since you are still breathing while eating and drinking your risk of inhaling contaminated air remains as well.

Finally, in many areas of society there is a stigma for those who wear any type of mask. The anti-mask movement is continuing to grow and spread worldwide causing many people to opt not to wear one for fear of alienation, and this problem is only getting worse as Covid fatigue continues.

Accordingly, solutions to the aforementioned problems in the art are needed and desirable.

SUMMARY OF THE INVENTION

Systems, apparatus and methods of the invention are directed to solving the problems mentioned above, among others.

The apparatus and methods of this patent disclosure will generally serve to eliminate, or at least greatly reduce, the need for mask wearing in order to remain protected from contagion. RNA type viruses such as Covid-19 are extremely simple lifeforms, in Covid's case having less than 30,000 base pairs in its RNA genome. Covid-19 contains a single positive RNA strand, which is 100,000 times smaller than the 3 billion double strand DNA base pairs found in the human genome. Moreover, the virus' genome replication protein, an RNA dependent polymerase (RdRp), is inherently flawed compared to human DNA polymerases, as RdRp does not have the proofreading activity limiting errors found in human cellular DNA replication. For example, in the case of the Omicron variant of Covid-19 only 5 base-pairs were mutated from the 30,000 in its genome. And yet this Omicron variant is 80 times more contagious than previous Delta variant. HIV is also an RNA virus and remains prevalent today 40 years later. The built-in mutation rate helps these viruses evade the immune system by creating slightly different protein variants which human antibodies are less able to recognize than previous variants. This helps the virus remain infectious, allowing it to complete its life cycle by continuing to infect mammalian cells.

For the foregoing reasons, and others, Covid-19 is likely here to stay and will become the new normal for society. The invention is thus in some embodiments directed to restarting or returning to some new version of normalcy while maintaining safety, as we try to balance the wheels of commerce with hospital ICU capacity. For reasons hereinafter more fully explained, the ability to remove one's mask and remain protected is enabled through use of the apparatus and methods of the invention. An advantage associated with the practice of this invention is the fact that the wearer of this device will remain anonymous or unknown using normal appearing head gear.

For example, a user can leave his house with an unobtrusive standard ball cap on his head and activate a filtration cloud or bubble of air near his/her nose/mouth through use of the present invention. The advantages associated with this invention are achieved through use of a fan on top of the head apparel that sucks air through filter media using an incorporated fan and directs this filtered air over the forehead of the wearer. This air steam has a tendency to stick to the curved features of the forehead and travel to the bridge of the nose where a trip-zone is generated. This trip-zone causes the air to disassociate from laminar to turbulent. This is used to our advantage with this present invention since this is where the majority of air intake occurs with humans, namely the nose. It must be noted that in the event a user is in windy conditions infection risk is greatly reduced by default yet the use of this device does not prevent also adding a backup surgical or N-95 mask.

The apparatus and methods of this patent disclosure will generally serve to eliminate, or at least greatly reduce, the need for anyone to wear a mask when in public. The applicant's apparatus serves numerous functions described herein including very simple variants where a baseball-type hat, that is a hat with a crown portion having a concave surface and a front bill, brim or visor connected thereto, generally referred to herein as a "ballcap", is worn with a fan using an integrated filter. While the invention may be discussed herein in connection with a ballcap, it will be understood that embodiments of the invention are adapted to work with a variety of hat styles and other wearable items. For example, the invention may be used and applied in connection with head gear, such as sports gear, including football, hockey and baseball helmets, motorcycle helmets, cowboy hats, beanies, knit hats, derbies and fedoras. The invention may be used in connection and/or in combination with helmets having other functions and features such as evaporative chilling features.

An exemplary embodiment of this invention uses a standard off-the-shelf surgical mask as the primary filter held-in-place (snapped) over the fan inlet thus providing a fully sealed filter for the wearer. This variation of the invention would incorporate a ballcap with a fan, a filter, an air duct or plenum and a discharge zone at the brim of the ballcap over the face of the wearer. In this variation the fan could be manually controlled with a standard on/off switch or remotely controlled with a blue-tooth or Wi-Fi connection with the wearers cell phone or computer. The power supply for this fan would be integrated within the ballcap or could be supplemented with either solar or a small earphone wire type feed from a hip or pocket placed battery pack normally used to assist in charging cell phones. In another variation of the invention the top knob on all ballcaps would also serve to adjust airflow from the brim flow to the area under the ballcap. This diverted air can be used to help cool someone wearing such type head apparel to help maintain a cool scalp while allowing for sun shielding with the cap itself, especially useful for those who have thinning hair or a weight problem since often overweight persons suffer with temperature regulation issues. As well the apparatus can be integrated with a felt pad above the fan that can be wetted with tap or bottled water allowing for convective natural evaporative cooling to assist in keeping the wearer cool. Temperature differentials of more than 30° Fahrenheit can be achieved in certain low humidity areas through this type of evaporative cooling. This is specifically useful in for example a hot ballpark or stadium especially when in direct sunlight such as is often the case during baseball and football games. Also, there is a proportional control using the knob on top or on the underside of the ballcap that can be adjusted or split the air in any ratio from face to scalp with this specific variation of the invention. This apparatus can also incorporate telemetry allowing for feedback to those using the device with their cell phones including measured head temperature and anemometer-based information from above the cap. This is important when considering windy open-air stadiums where filtered air flow is not necessary allowing for automated shutdown of the apparatus to save batteries in these windy conditions. In another variation of the invention the front ballcap visor has an integrated clear plastic visor which when pivoted down will help to protect eyes and breathing zones. In yet another variation of the invention there exists a mist type nebulizer which is pulsed every "X" minutes to deliver a puff of natural or medicinal protection for the wearer. Examples of natural protection would include a sea-salt mist shot of nebulized air to assist in naturally killing viral pathogens within the nasal sinuses. Other types of nebulizer pulses could include Iodine as well a prescription-based cleansing agent. Also, another variation of the invention allows for this wetting pad to be doped with a drop or two of; example lavender oil to supply a natural odor or fragrance to the wearer. There are many areas this approach of infusing air with natural essential oils can be beneficial. Including school and home setting with children afflicted with downs-syndrome or autism or even adults with anxiety, depression or sleeping disorders. Naturopaths worldwide are specialists in recommending these type of natural remedies using the inventions delivery capability. Also, another variation of the invention allows for replacement of the felt wetting pad with an activated carbon pad. This carbon pad is proven useful in trapping and mitigate odors, specifically this variation of the invention would find use for those working as nurses' aids or frontline workers in recycling plants where odor is often an issue daily. Finally, since one variation of the invention is fully standalone the possibility exists to place the device on ones' chest with the air discharge nozzle pointing upwards towards the mouth and nose. This variation of the invention could also be used in conjunction with the upper delivery system creating a collision of the two air flows around the breathing zones further assisting in protecting the wearer.

In some embodiments, the invention is directed to a device comprising a fan, filter and battery integrated into wearable headgear, such as a ballcap, which is configured to deliver clean filtered air to the wearer. The device of this embodiment is light-weight simple and has a high air-to-cloth filtration ratio making it ideal for most applications. The cost of this manufacturing this embodiment commercially is envisioned to be relatively low at least because the air plenums are air blocking types of fabric integrated into the ballcap itself.

In some embodiments, the invention is directed to a device comprising a fan, filter and battery integrated into wearable headgear, such as a ballcap, which is configured to deliver clean filtered air to the wearer but also with an integrated blue-tooth or Wi-Fi connection to one's cell phone and allowing for battery backup with a belt connection supplementary power-pack. This variation could also incorporate a solar charger and integrated telemetry such as temperature measurement and real-time graphing and storage including information such as remaining battery life. Graphing temperature could also give feedback on possible infection onset.

In some embodiments, the invention is directed to a device comprising a fan, filter and battery integrated into wearable headgear, such as a ballcap, which is configured to deliver clean filtered air to the wearer but also with an integrated blue-tooth or Wi-Fi connection to one's cell phone and allowing for battery backup with a belt clipped supplementary power-pack. This variation could also incorporate a solar charger and integrated telemetry such as temperature measurement and real-time graphing and storage including information such as remaining battery life. In addition, this embodiment includes a feature enabling the possibility to split the airflow between head cooling and face filtration and would also include an optional face-shield visor which can be lowered to help protect the wearer from wind and viral droplets from infected individuals. The split control would occur using a coin on the inside of the ballcap rotated CW or CCW splitting this airflow. Another possibility is to incorporate a proportional control potentiometer on the top knob of the ballcap that controls a small DC motor driven servo that effects the control ratio.

In another embodiment of the invention, the embodiments described above are made as fully standalone head apparel or in this variation this entire apparatus could be removable and adapted to interface with whatever head apparel the user decides. For example, during the summer a ball cap is preferred however in the winter a woolen took may be more advantageous. Ones' specific location weather would allow the person to decide which version makes sense. It must be noted that one key advantage when going with the integrated embodiments described above is the ability to make these potentially less heavy or lightweight since the cloth material of the ballcap itself can be made moisture and airtight allowing for air delivery through a plenum within the ballcap structure itself.

A possible variation of these embodiments of the invention incorporates the standalone version whereby this mechanism is tucked under the coat or sweatshirt just below the chin allowing for clean filtered air to project upwards to the breathing zones. In this configuration there is an advantage since we can incorporate features of these embodiments to form a secure filtered air bubble zone for the wearer. This may be advantageous in the event that a pandemic involves an infectious agent that is highly contagious, such as Omicron Covid, as well as also being deadly, such as Ebola.

Some embodiments of the invention are directed to an apparatus for providing cooled clean filtered air for, said apparatus comprising: (a) a housing containing a fan capable of rotating within a secondary housing independently from the fixed body of the apparatus; (b) a fixed body with a fixture allowing for a separate retaining ring or loop to affixed to a standard surgical mask or custom filter with an airtight seal around the fixed component of the apparatus; (c) a device for powering the pivoting fan housing fan module to allow this fan to operate while permitting it a certain rotational movement with respect to the fixed body of the apparatus (e.g., 30° clockwise or counter-clockwise); (d) a device for pivoting fan housing fan module either below the apparatus using a coin or above using a potentiometer and servo driven control that rotates the fan module; (e) an air plenum integrated or independently interfaced with the fixed body discharge allowing for filtered air to be delivered to two specific locations used to protect the user form inhaling contaminated air such as those related to viral infection and natural convective cooling on the scalp of the user; (f) a device for controlling and monitoring this fan including the ability to use telemetry obtained as feedback for its safety and operational efficiency; (g) a device for allowing the user to supplement the stand-alone operation of this device with external power; (h) a device for blue tooth and Wi-Fi connectivity for both input and output control and telemetry; and (i) a device for permitting both integrated and stand-alone operation of the apparatus.

Some embodiments of the aforementioned apparatus further comprise a device for integrating a misting nebulizer either passively driven through natural evaporation driven by the fan or assisted with the use of a piezo or even a small pressurizing electric pump to generate aerosols. These aerosols are useful to assist in filtering and killing pathogens in the nasal cavity itself. In normal operation the piezo version would be cycled with a single puff of nebulized mist every "x" minutes for an instant typically 100 ms. The piezo element would mist example: salt (seawater) or Iodine based or prescription based medication designed to kill pathogens that have lodged in the sinuses as well the deliver zone could potentially be integrated within the brim of the ballcap if allowing the user to pivot a misting nozzle closer to the nostrils and possibly triggered with a gentle chime or vibration 10 seconds before delivery.

Some embodiments of the aforementioned apparatus further comprise a device for integrating an interface with the top knob potentiometer of a ballcap driving a servo motor to rotate the fan module allowing the user to select for split air ratio between forehead and scalp area which would be kept cool with a wetted pad using bottled or tap water to allow convective cooling of both zones.

Some embodiments of the aforementioned apparatus, further comprise a variation whereby the user can remove the apparatus and transfer it to a winter took from a baseball cap if desired.

Some embodiments of the aforementioned apparatus further comprise a variation whereby the user generates a flow from the chest area upwards towards the chin possibly in conjunction with the upper flow allowing for a double flow from above and below further protecting the user from infection.

Some embodiments of the aforementioned apparatus further comprise a version in which the air plenum is integrated into the fixed fabric of the head apparel such as a ballcap whereby the fabric is coated with an air barrier allowing air to flow in specific zones within the apparel.

Some embodiments of the aforementioned apparatus further comprise a version whereby the fan can be reversed either electrically or mechanically rotated 180° to permit the device to help remove risk for others when the wearer is infected with viral load such as those with Covid-19. This would help protect health workers with one more level of protection since the air entering the cap intake would be filtered in revers with respect to the filter media. This reverse flow would trap infectious air particulate internally on the filter media.

Some embodiments of the aforementioned apparatus further comprise a variation whereby the fan is removed and replace with a puffer mechanism such as a piezo element allowing for a cloud of mist to be presented to the user from the same discharge area above the forehead with this mist containing salt (seawater) or Iodine based or prescription based medication designed to kill pathogens that have lodged in the sinuses this puff would be programmed to deliver this puff every example: 15 minutes or as programmed as well the deliver zone could potentially be integrated within the brim of the ballcap if allowing the user to pivot a misting nozzle closer to the nostrils and possibly triggered with a gentle chime or vibration 10 seconds before delivery.

Some embodiments of the invention are directed to an apparatus configured to be mounted on a hat wearable on a human head and provide filtered air in an area adjacent to the face of a wearer of the hat, the hat having a crown portion with a concave surface and a brim having an upper side and a lower side, the lower side being adjacent to the area adjacent to the face, said apparatus comprising: a) an inner housing defining an upper side, lower side, a side wall, and a cavity therein, the upper side forming an engagement with the crown portion of the hat whereby the inner housing is supported within the crown portion, wherein the upper side includes a first opening (or fan inlet) in contact with the concave surface of the crown portion and in fluid communication with the cavity, and wherein the side wall includes a second opening (or fan outlet or discharge) in fluid communication with the cavity; b) a fan mounted in the cavity; and c) a duct including a first opening and a second opening, the first opening being operatively associated with the second opening of the inner housing for enabling fluid communication from the cavity into the duct, the duct including a second opening adjacent to the lower side of the brim, wherein the engagement of the upper side of the housing and the crown portion of the hat is further configured to receive a filter cover configured to cover the first opening.

In some embodiments of the aforementioned apparatus the duct is constructed of a substantially flexible material, which may be a fabric.

In some embodiments of the aforementioned apparatus the inner housing may be generally disc-shaped or cylindrical. In some embodiments of the aforementioned apparatus the inner housing is constructed of a substantially flexible material.

Some embodiments of the aforementioned apparatus further comprise a third opening in the lower side of the inner housing, wherein the third opening is in fluid communication with the cavity.

In some embodiments of the aforementioned apparatus the inner housing is mounted for rotational motion within an outer housing. The outer housing may further include a first opening in fluid communication with the third opening in the lower side of the inner housing and a second opening in fluid communication with the second opening in the side wall of the inner housing, the second opening of the outer housing being connected with the first opening of the duct, wherein the rotational motion of the inner housing relative to the outer housing alternately restricts and derestricts one or both of (i) fluid communication between the first opening of the outer housing and the third opening in the lower side of the inner housing and (ii) fluid communication between the second opening of the outer housing and the second opening in the side wall of the inner housing.

In some embodiments of the aforementioned apparatus the engagement of the upper side of the housing and the crown portion of the hat further comprises a raised edge defined around the first opening in the upper side of the inner housing and a frame member configured to engage with the rim.

Some embodiments of the invention are directed to an apparatus configured to be mounted on a hat wearable on a human head and provide filtered air in an area adjacent to the face of a wearer of the hat, the hat having a crown portion with a concave surface and a brim having an upper side and a lower side, the lower side being adjacent to the area adjacent to the face, said apparatus comprising: a) an inner housing defining an upper side, lower side, a side wall, and a cavity therein, the upper side forming an engagement with the crown portion of the hat whereby the inner housing is supported within the crown portion, wherein the upper side includes a first opening in contact with the concave surface of the crown portion and in fluid communication with the cavity, and wherein the side wall includes a second opening in fluid communication with the cavity; b) a fan mounted in the cavity; c) a duct including a first opening and a second opening, the duct being substantially constructed of a fabric material, the first opening being operatively associated with the second opening of the inner housing for enabling fluid communication from the cavity into the duct, the duct including a second opening adjacent to the lower side of the brim; and d) a power source in electrical communication with the fan, wherein the engagement of the upper side of the housing and the crown portion of the hat is further configured to receive a filter cover configured to cover the first opening, the engagement of the upper side of the housing and the crown portion of the hat comprising a raised edge defined around the first opening in the upper side of the inner housing and a frame member configured to engage with the rim.

BRIEF DESCRIPTION OF THE DRAWINGS

While the disclosure concludes with claims particularly pointing out and distinctly claiming specific embodiments, various features and advantages of embodiments within the scope of this disclosure may be more readily ascertained from the following description when read in conjunction with the accompanying drawings, some or all of which may or may not be drawn to scale, in which:

DETAILED DESCRIPTION OF SOME EMBODIMENTS OF THE INVENTION

Figure 1:
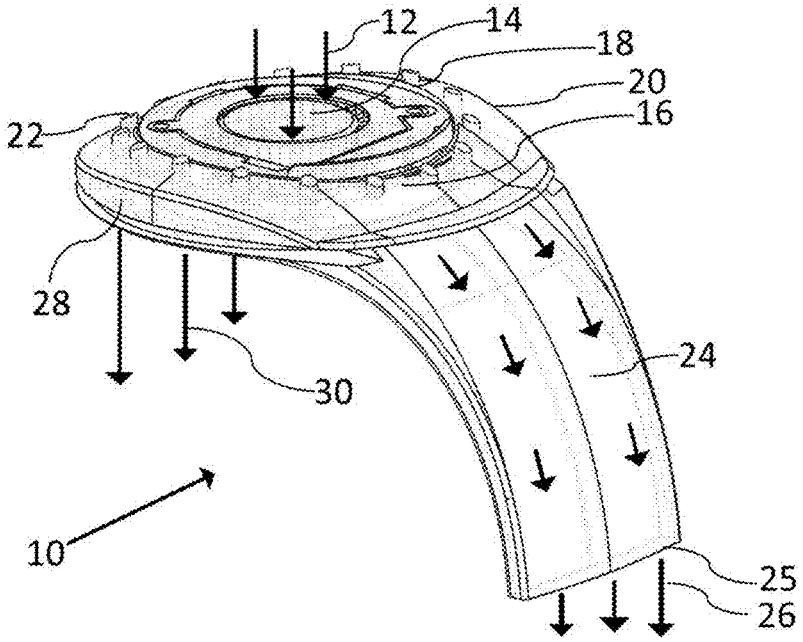
FIG. 1 is a perspective view of a portion of the filtered air delivery system (i.e., the CAP (Covid Active Protection)) shown provided with certain apparatus constructed in accordance with the invention.

The embodiments now will be described more fully hereinafter with reference to the accompanying drawings, in which illustrative embodiments of the invention are shown. The embodiments disclosed herein can be embodied in many different forms and should not be construed as limited to the embodiments set forth herein; rather, these embodiments are provided so that this disclosure will be thorough and complete, and will fully convey the scope of the invention to those skilled in the art. In general, like numbers refer to like elements throughout. As used herein, the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes", "including", "comprises", and/or "comprising," when used in this specification, specify the presence of stated features, steps, operations, elements, and/or components, but do not preclude the presence or addition of one or more other features, integers, steps, operations, elements, components, and/or groups thereof.

References to "one embodiment," "at least one embodiment," "an embodiment," "one example," "an example," "for example," and so on indicate that the embodiment(s) or example(s) may include a particular feature, structure, characteristic, property, element, or limitation but that not every embodiment or example necessarily includes that particular feature, structure, characteristic, property, element, or limitation. Further, repeated use of the phrase "in an embodiment" does not necessarily refer to the same embodiment.

Methods of the present invention may be implemented by performing or completing manually, automatically, or a combination thereof, selected steps or tasks. The term "method" refers to manners, means, techniques, and procedures for accomplishing a given task including, but not limited to, those manners, means, techniques, and procedures either known to or readily developed from known manners, means, techniques, and procedures by practitioners of the art to which the invention belongs. The descriptions, examples, methods, and materials presented in the claims and the specification are not to be construed as limiting but rather as illustrative only. Those skilled in the art will envision many other possible variations within the scope of the technology described herein.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In this description, various aspects of selected embodiments are described. However, it will be apparent to those of ordinary skill in the art and others that alternate embodiments may be practiced with only some or all of the aspects. For purposes of explanation, specific numbers, materials and configurations are set forth in order to provide a thorough understanding of the embodiments. However, it will be apparent to those of ordinary skill in the art and others that alternate embodiments may be practiced without the specific details. In some instances, well-known features are omitted or simplified in order not to obscure the illustrated embodiments.

Various operations may be described herein as multiple discreet steps in turn, in a manner that is helpful to understanding of the embodiments. However, the order of description should not be construed to imply that these operations are necessarily order dependent. In particular, these operations may not be performed in the order of presentation.

FIG. 1 show shows an exemplary embodiment of an apparatus constructed according to the principles of the invention generally designated by the reference numeral 10. Apparatus 10 comprises an integrated mechanism consisting of a clean filtered air delivery system integrated into a head apparel whereby air is pulled through an opening in the apparatus 10 at location 12 pulled through filter media via a fan 14 into a plenum 16 which changes the direction of the air 90 degrees within a cylindrical receptor 18 capable of rotating within the main structure 20. The cylindrical receptor 18 maintains a clearance from a filter media (not shown) which is held above the fan 14 with a plurality of stand-offs 22 which keep the filter material from physically adhering to the fan 14. These standoffs 22 can also be slits or gaps allowing air to freely pass into the fan 14. One of the main purposes for this configuration is to increase the available surface area to maximize air to cloth ratio. The air is primarily directed towards an integrated plenum 16 the purpose of which is to direct the air 90 degrees towards one of two discharge locations within the fixed body 20 the first being in-line with the brim 25 of a hat apparel 34 concealed at the edge of the brim 25 and used to transmit clean filtered air to the discharge location 26 discharging this air at the top of a person's hairline parallel to the forehead. In addition, there exists the possibility of rotating the cylindrical receptor 18 clockwise or counter-clockwise a certain angular distance, example 30 degrees with this apparatus either manually or electronically using a potentiometer on top of the cap to proportionally rotate 18 to any desired position on apparatus 10 allowing an analog percentage of the airflow to be diverted from discharge location 26 via an plurality of discharge nozzles 28 into the area below the apparatus 10 depictured by arrows 30 but above the head of a wearer 54. This analog variation allows the wearer 54 to choose depending on conditions example within a bank safety is important therefore supply air over the forehead then outside walking to the car switch to air conditioning mode. The possibility exists that this switching could be automatic based on temperature and feedback such as detection of sunlight or wind.

Figure 2:
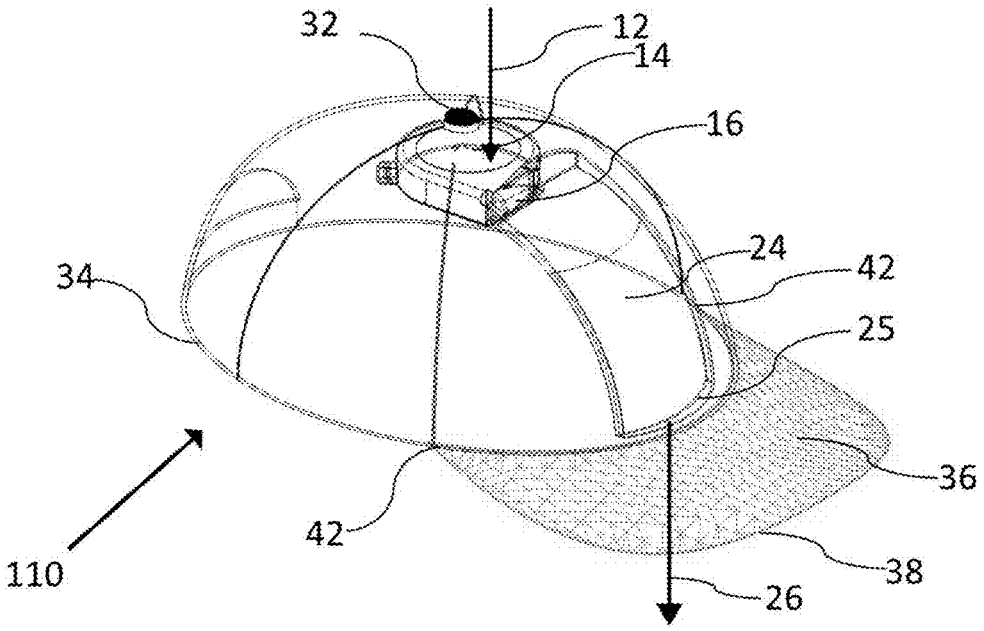
FIG. 2 is an encompassed view of the filtration mechanism integrated into a baseball cap of FIG. 1 showing the ball cap with the fan and air plenum combined.

FIG. 2 shows an exemplary embodiment of an apparatus constructed according to the principles of the invention generally designated by the reference numeral 110 with partial integrated numeral 10 showing a simplified of apparatus with fan 14 pulling air through a filter (not shown) into the fan body delivering this air into plenum 24 within ballcap 34 to the discharge nozzle location 26 at the brim of the ballcap 34 just above the brim where the air is discharged the sun shield 36 which has within it and residing just below this sun shield a clear plastic second shield 38 depicted in the nested position which can be lowered to help keep air within the breathing zone (that is, optionally rotated 90 degrees) on top of the ballcap there is a knob 32 which can rotate in this configuration clockwise or counter clockwise, by for example about 30°, to adjust the ratio of air that can be diverted into the area above the ballcap verses that which is flowing over the face. Control of this rotation occurs through the use of an electric servo controlled by the potentiometer on top of the ballcap to change this air flow. This air can be optionally further cooled by wetting a felt pad with bottled or tap water to generate natural cooling though the evaporative cooling cycle. This works particularly well in areas with low humidity such as Arizona and New Mexico and parts of Texas.

Figure 3:
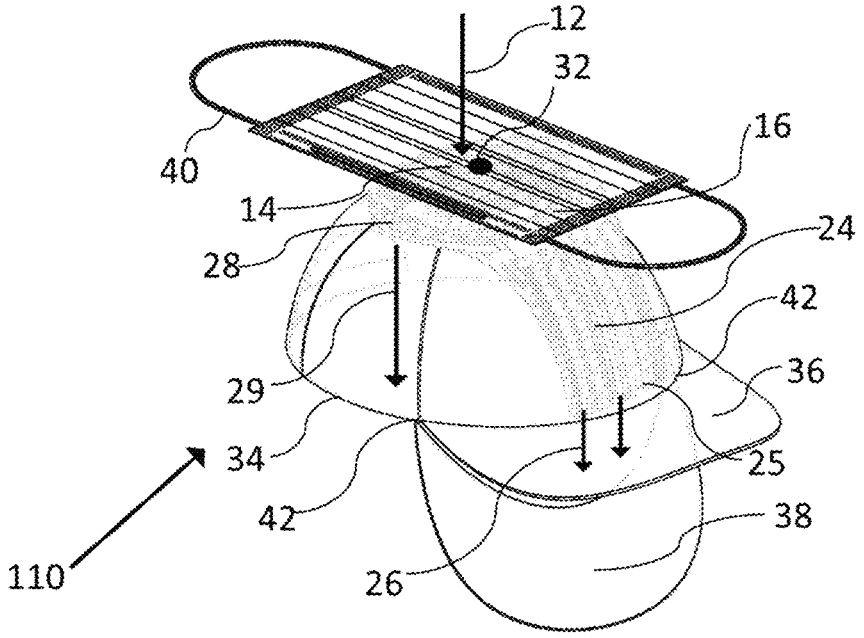
FIG. 3 is another perspective view of the embodiment of the invention shown in FIG. 1, wherein the surgical mask is shown ready to be installed with an additional option of a clear protective visor integrated into the sun shield.

FIG. 3 shows an exemplary embodiment of an apparatus constructed according to the principles of the invention generally designated by the reference numeral 110 with full integration of FIG. 2 and all of the numeral 10 (minus the servo control, batteries and any other electronics required for specific variations of the invention here we see the second shield 38 deployed using two hinge points 42 on either side of the sun shield 36 attached to the ballcap 34.

Figure 4:
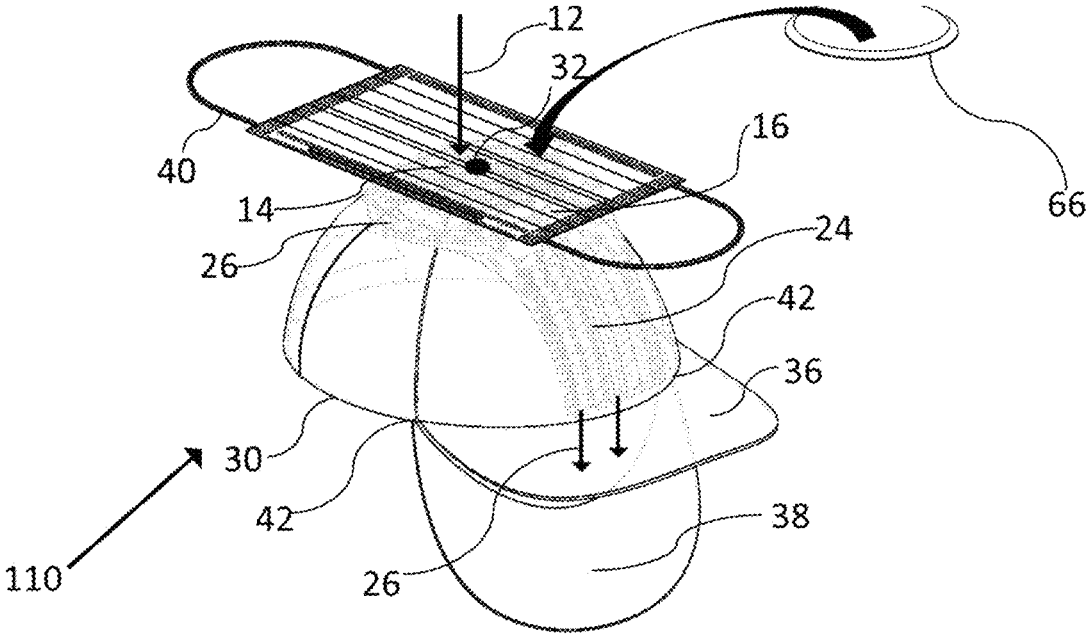
FIG. 4 is another perspective view of the embodiment of the invention shown in FIG. 1 but wherein we see the surgical mask ready to be installed with an additional option of a clear protective visor integrated into the sun shield and a pad addition.

FIG. 4 shows an exemplary embodiment of an apparatus constructed according to the principles of the invention generally designated by the reference numeral 110 with full integration of FIG. 3 and all of the numeral 10 (minus the servo control, batteries and any other electronics required for specific variations of the invention here we see the cap visor 38 deployed using two hinge points 42 on either side of the sun shield 36 attached to the ballcap 34. As well this version of the invention has a felt pad 66 which can be use in place of filter 40 or in addition to this filter. This pad can be felt to allow for addition of essential oils such as lavender or it could be infused with salt water to help kill pathogens within our sinuses or even prescription aerosols that again could help keep pathogen infection to a minimum.

Figure 5:
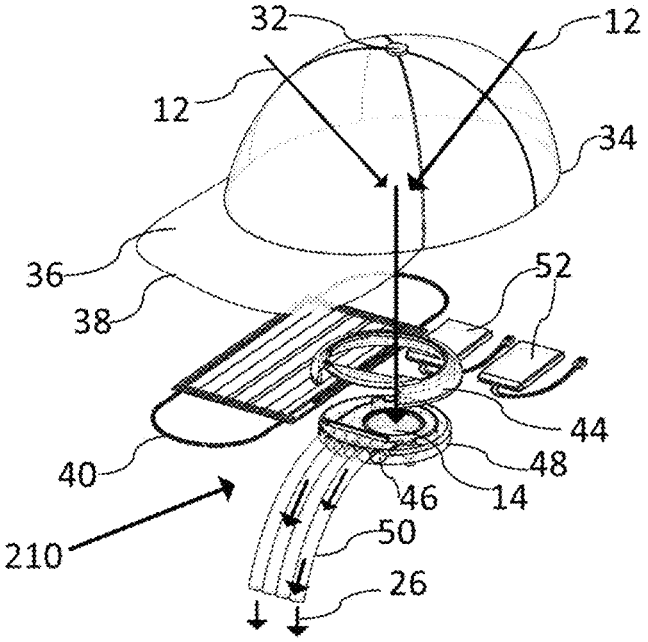
FIG. 5 is another embodiment of the invention, which is generally a more compact, lighter and thinner version of the invention with surgical type tubing to be used as conduit to transmit the air flow making it more comfortable to wear.

FIG. 5 shows an exemplary embodiment of an apparatus constructed according to the principles of the invention generally designated by the reference numeral 210 this is a simplified variation of the embodiment shown in FIG. 1 that provides for a potentially less expensive lighter weight version. The invention consists of a fan 14 contained within a housing 48 with a discharge plenum 46 directing the inlet air pulled from above the ball cap 34 through the fan 14 and directed 90° to the plenum 46 into either a surgical tubing type conduit 50 shown here or a fabric plenum integrated into the ballcap 34 also feeding power to the fan are one or more batteries 52 ideally flat type shown here to power the fan 14. We also see filter 40 held in place with a clamping ring 44 used to secure the entire assembly. In this configuration a control knob is not needed or used and a cosmetic knob 32 serves only cosmetically however this version of the invention may or may not contain a second shield.

Figure 6:
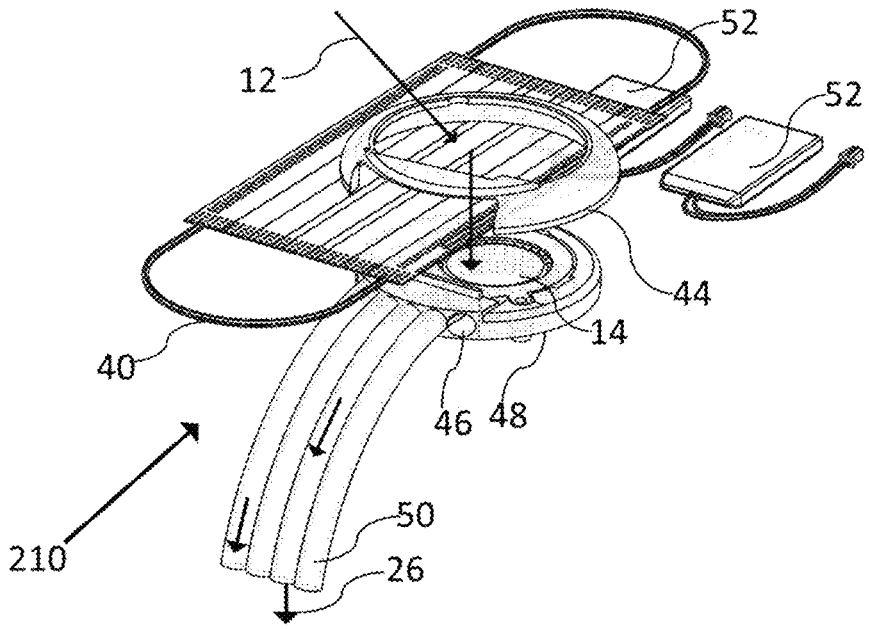
FIG. 6 is a close-up of the embodiment of the invention shown in FIG. 5, illustrating that the off-the-shelf inexpensive surgical mask is inserted in between the body and the upper retaining clamping ring.

FIG. 6 shows an exemplary embodiment of an apparatus constructed according to the principles of the invention generally designated by the reference numeral 210 this is a simplified variation of numeral 10 that allows for a less expensive lighter weight version of numeral 10. FIG. 6 shows a generally simplified view of the embodiment shown in FIG. 5 with the ballcap removed to better show the workings of this variant air pulled through the filter 40 into a fan 14 powered by one or more batteries 52 and held within a housing 48 delivering air to a plenum discharge 46 into a conduit 50 to deliver clean filtered air to the user.

Figure 7:
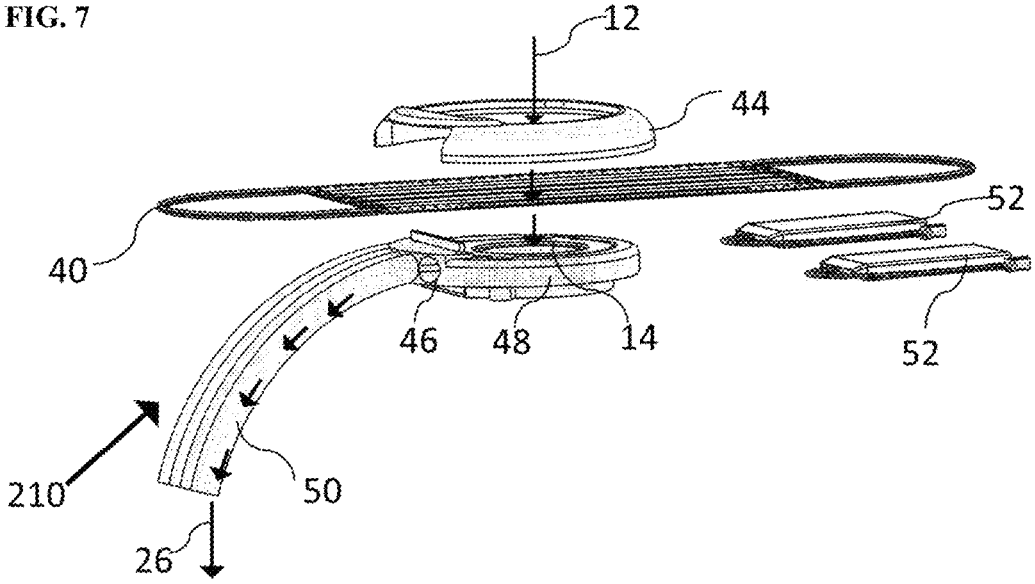
FIG. 7 is a more skewed view of the embodiment of the invention shown in FIG. 5 showing this variant more clearly in and exploded view.

FIG. 7 show shows a side view of an apparatus constructed according to the principles of the invention generally designated by the reference numeral 210 and depicted within FIGS. 5 and 6. This view shows how the assembly comes together with the filter 40 trapped between the housing 48 held in place by the clamping ring 44 delivering unfiltered air to the plenum discharge 46 into the conduit 50 to discharge clean filtered air.

Figure 8:
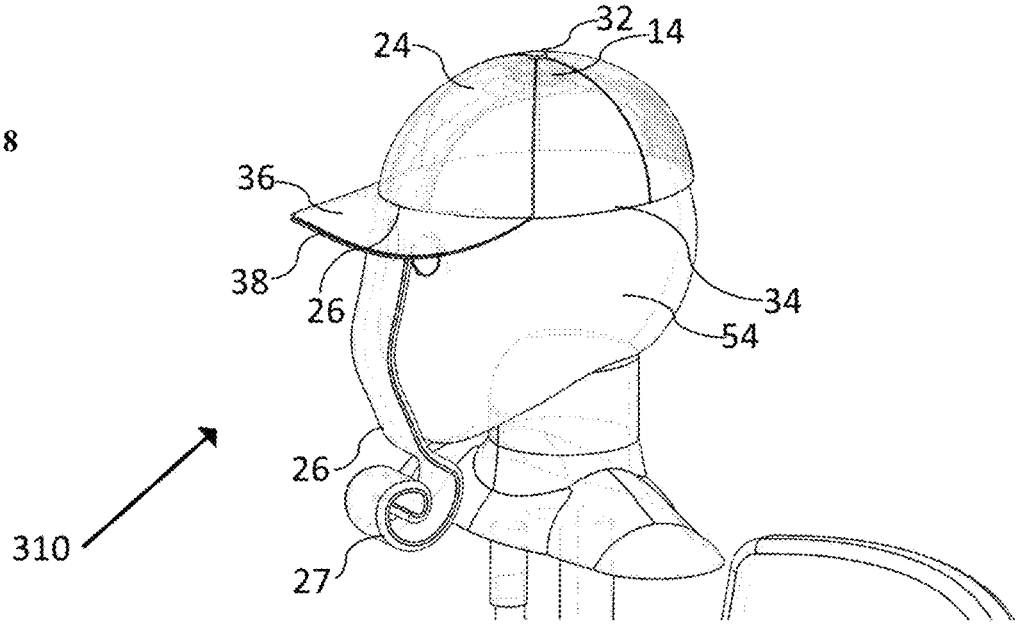
FIG. 8 is a generalized view of an embodiment of the invention showing the air flow over a mannequin to demonstrate how the airflow attaches itself to the face and where it begins to delaminate.

FIG. 8 show shows a side view of an apparatus constructed according to the principles of the invention generally designated by the reference numeral 310 and depicted with a simplified embodiment of numerical 10 contained within a ballcap 34 with a conventional sun shield 36 and second shield 38 sitting on a mannequin 54 delivering clean filtered air across the nose and mouth of the mannequin 54 depicting the change that occurs when air goes from laminar depicted and shown at discharge location 26 to turbulent air flow shown at location 27. It must be noted that there is a second trip zone not shown at the nose at the nostril area where most of the air intake occurs.

Figure 9:
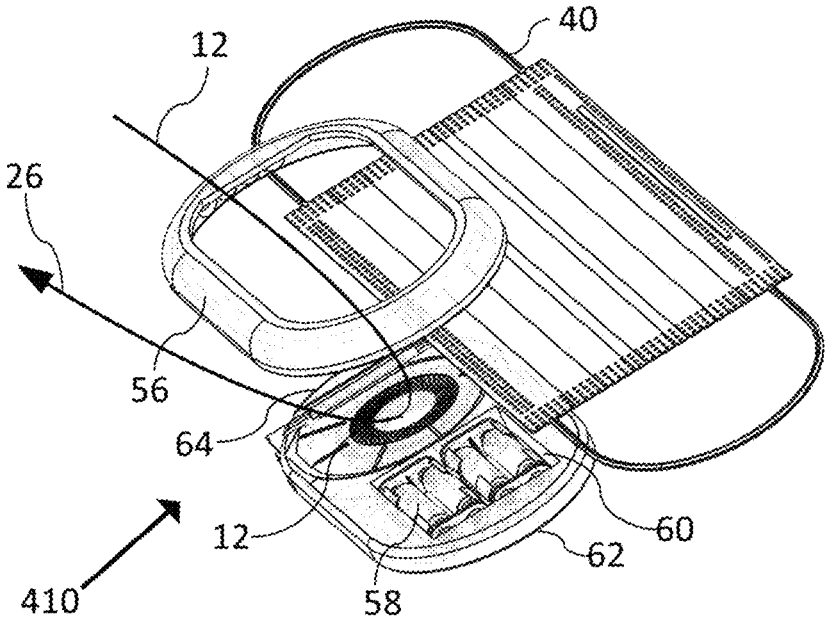
FIG. 9 is a more elongated variation of an embodiment of the invention which can be nested close to the chest on the rib cage area below the chin used to generate an upward clean air-flow used alone or in conjunction with the upper variant.

FIG. 9 show shows another variation of the apparatus constructed according to the principles of the invention generally designated by the reference numeral 410 and depicted within FIG. 9 this variation of the invention operates in a similar fashion as the previous FIGS. 1-8 in that air enters the apparatus 410 through the filter 40 into the fan 14 held within a housing 62 that has a power source such as AAA or AA batteries 58 held within a cavity 60 directly pushing filtered air out location 64. Filter 40 is secured in place over the opening of housing 62 of apparatus 410 by frame 56. Housing 62 and frame 56 may include features which interlock or snap-fit, such as raised edge, rim or flange, or otherwise enable the formation of a non-permanent engagement between frame 56 and housing 62.

Figure 10:
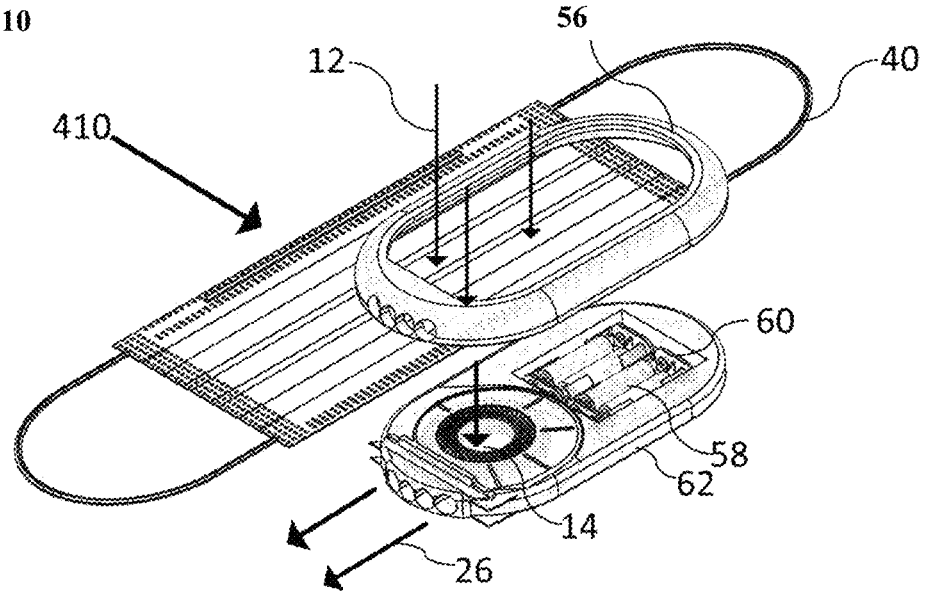
FIG. 10 is an isometric view of the embodiment shown in FIG. 8 describing additional potential components in the assembly.

FIG. 10 show shows an isometric view of the embodiment shown in FIG. 9 illustrating the apparatus constructed according to the principles of the invention generally designated by the reference numeral 410 and depicted within FIG. 9 this variation of the invention operates in a similar fashion as the previous FIGS. 1-8 in that air enters the apparatus 12 through the filter 40 into the fan 14 held within a housing 62 that likely has AAA or AA batteries 58 held within a cavity 60 directly pushing filtered air out location 64.

Figure 11:
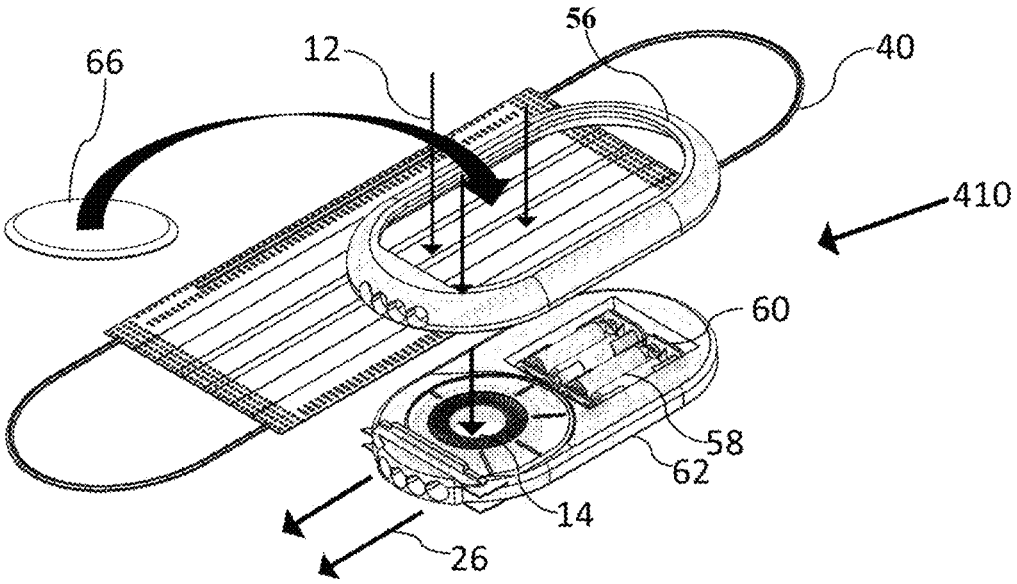
FIG. 11 is another isometric view of the embodiment shown in FIG. 8 describing additional potential components in the assembly.

FIG. 11 show shows an isometric view of the embodiment shown in FIGS. 9-10 showing the apparatus constructed according to the principles of the invention generally designated by the reference numeral 410 and depicted within FIG. 9 this variation of the invention operates in a similar fashion as the previous FIGS. 1-8 in that air enters the apparatus 12 through the filter 40 into the fan 14 held within a housing 62 that likely has AAA or AA batteries 58 held within a cavity 60 directly pushing filtered air 26 out location 64 as well the variation of the invention shown in FIG. 11 includes the addition of a felt pad 66 which can be use in place of filter 40 or in addition to this filter. This pad can be felt to allow for addition of essential oils such as lavender or it could be infused with salt water to help kill pathogens within our sinuses or even prescription aerosols that again could help keep pathogen infection to a minimum.

The systems and methods described herein may be a standalone system, device or machine, or incorporated in an existing system, device or machine. As will be appreciated by one of skill in the art following the disclosure provided herein, the present invention can be facilitated or integrated with a data processor, or other hardware and software. A system, method or apparatus of the invention may therefore include various computer and network related software and hardware, such as programs, operating systems, memory storage devices, data input/output devices, data processors, servers with links to data communication systems, wireless or otherwise, and data transceiving terminals. It should also be understood that any method steps discussed herein may further include or involve the transmission, receipt and processing of data through conventional hardware and/or software technology to effectuate the steps as described herein. Aspects of the embodiments which include process steps and instructions described herein may be in the form of an algorithm. It should be noted that the process steps and instructions of the embodiments can be embodied in software, firmware, or hardware, and when embodied in software, could be downloaded to reside on and be operated from different platforms used by a variety of operating systems.

In some embodiments, the methods, systems, and media disclosed herein include software, server, and/or database modules, or use of the same. In view of the disclosure provided herein, software modules are created by techniques known to those of skill in the art using machines, software, and languages known to the art. The software modules disclosed herein are implemented in a multitude of ways. In various embodiments, a software module comprises a file, a section of code, a programming object, a programming structure, or combinations thereof. In further various embodiments, a software module comprises a plurality of files, a plurality of sections of code, a plurality of programming objects, a plurality of programming structures, or combinations thereof. In various embodiments, the one or more software modules comprise, by way of non-limiting examples, a web application, a mobile application, and a standalone application. In some embodiments, software modules are in one computer program or application. In other embodiments, software modules are in more than one computer program or application. In some embodiments, software modules are hosted on one machine. In other embodiments, software modules are hosted on more than one machine. In further embodiments, software modules are hosted on cloud computing platforms. In some embodiments, software modules are hosted on one or more machines in one location. In other embodiments, software modules are hosted on one or more machines in more than one location.

In some embodiments, the methods, systems, and media disclosed herein include one or more databases or use of the same. In view of the disclosure provided herein, those of skill in the art will recognize that many databases are suitable for storage and retrieval of player and game information. In various embodiments, suitable databases include, by way of non-limiting examples, relational databases, non-relational databases, object-oriented databases, object databases, entity-relationship model databases, associative databases, and XML databases. In some embodiments, a database is internet-based. In further embodiments, a database is web-based.

In still further embodiments, a database is cloud computing-based. In other embodiments, a database is based on one or more local computer storage devices.

A controller, computing device, or computer, such as described herein, may include at least one or more processors or processing units and a system memory. The controller typically also includes at least some form of computer-readable media. By way of example and not limitation, computer-readable media may include computer storage media and communication media. Computer storage media may include volatile and nonvolatile, removable and non-removable media implemented in any method or technology that enables storage of information, such as computer-readable instructions, data structures, program modules, or other data. Communication media typically embody computer-readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer-readable media.

In some embodiments, a controller may include a processor, which as described herein, includes any programmable system including systems and microcontrollers, reduced instruction set circuits (RISC), application-specific integrated circuits (ASIC), programmable logic circuits (PLC), and any other circuit or processor capable of executing the functions described herein. The above examples are exemplary only and thus are not intended to limit in any way the definition and/or meaning of the term processor.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

This written description uses examples to disclose the invention and also to enable any person skilled in the art to practice the invention, including making and using any devices or systems and performing any incorporated methods. The patentable scope of the invention may include other examples that occur to those skilled in the art. Other aspects and features of the invention can be obtained from a study of the drawings and the disclosure. The invention may be practiced otherwise than as specifically described herein. It should also be noted, that the steps and/or functions listed herein, notwithstanding the order of which steps and/or functions are listed, are not limited to any specific order of operation.

While exemplary apparatus, systems and methods of the invention have been described herein, it should also be understood that the foregoing is only illustrative of a few particular embodiments with exemplary and/or preferred features, as well as principles of the invention, and that various modifications can be made by those skilled in the art without departing from the scope and spirit of the invention. Therefore, the described embodiments should not be considered as limiting of the scope of the invention in any way. Accordingly, the invention embraces alternatives, modifications and variations which fall within the spirit and scope of the invention as set forth herein, in the claims and any equivalents thereto.

The invention claimed is:

1. An apparatus configured to be mounted on a hat wearable on a human head and provide filtered air in an area adjacent to the face of a wearer of the hat, the hat having a crown portion with a concave surface and a brim having an upper side and a lower side, the lower side being adjacent to the area adjacent to the face, said apparatus comprising:

a) a housing defining an upper side, lower side, a side wall, and a cavity therein, the upper side being configured to contact the crown portion of the hat whereby the housing is supported within the crown portion, wherein the upper side includes a first opening in contact with the concave surface of the crown portion and in fluid communication with the cavity, and wherein the side wall includes a second opening in fluid communication with the cavity;

b) a fan mounted in the cavity; and c) a duct including a first opening and a second opening, the first opening being operatively associated with the second opening of the housing for enabling fluid communication from the cavity into the duct, the second opening being adjacent to the lower side of the brim, wherein the upper side of the housing is further configured to receive a filter cover configured to cover the first opening, and wherein the duct is constructed of a substantially flexible material.

2. The apparatus of claim 1, wherein the substantially flexible material is a fabric.

3. The apparatus of claim 2, wherein the housing is generally disc-shaped.

4. The apparatus of claim 3, wherein the housing is constructed of a substantially flexible material.

5. The apparatus of claim 1, further comprising a third opening in the lower side of the housing, wherein the third opening is in fluid communication with the cavity.

6. The apparatus of claim 5, wherein the housing is mounted for rotational motion within a main structure.

7. The apparatus of claim 6, wherein the main structure includes a first opening in fluid communication with the third opening in the lower side of the housing and a second opening in fluid communication with the second opening in the side wall of the housing, the second opening of the main structure being connected with the first opening of the duct, wherein the rotational motion of the housing relative to the main structure alternately restricts and derestricts one or both of (i) fluid communication between the first opening of the main structure and the third opening in the lower side of the housing and (ii) fluid communication between the second opening of the main structure and the second opening in the side wall of the housing.

8. The apparatus of claim 1, further comprising a power source in electrical communication with the fan.

9. An apparatus configured to be mounted on a hat wearable on a human head and provide filtered air in an area adjacent to the face of a wearer of the hat, the hat having a crown portion with a concave surface and a brim having an upper side and a lower side, the lower side being adjacent to the area adjacent to the face, said apparatus comprising:

a) a housing defining an upper side, lower side, a side wall, and a cavity therein, the upper side being configured to contact the crown portion of the hat whereby the housing is supported within the crown portion, wherein the upper side includes a first opening in contact with the concave surface of the crown portion and in fluid communication with the cavity, and wherein the side wall includes a second opening in fluid communication with the cavity;

b) a fan mounted in the cavity;

c) a duct including a first opening and a second opening, the duct being substantially constructed of a fabric material, the first opening being operatively associated with the second opening of the housing for enabling fluid communication from the cavity into the duct, the second opening being adjacent to the lower side of the brim; and d) a power source in electrical communication with the fan, wherein the upper side of the housing is further configured to receive a filter cover configured to cover the first opening, the upper side of the housing and the crown portion of the hat comprising a raised edge defined around the first opening in the upper side of the housing.

10. The apparatus of claim 9, wherein the housing is generally cylindrical.

11. The apparatus of claim 10, wherein the housing is constructed of a substantially flexible material.

12. The apparatus of claim 9, further comprising a third opening in the lower side of the housing, wherein the third opening is in fluid communication with the cavity.

13. The apparatus of claim 12, wherein the housing is mounted for rotational motion within a main structure.

14. The apparatus of claim 13, wherein the main structure includes a first opening in fluid communication with the third opening in the lower side of the housing and a second opening in fluid communication with the second opening in the side wall of the housing, the second opening of the main structure being connected with the first opening of the duct, wherein the rotational motion of the housing relative to the main structure alternately restricts and derestricts one or both of (i) fluid communication between the first opening of the main structure and the third opening in the lower side of the housing and (ii) fluid communication between the second opening of the main structure and the second opening in the side wall of the housing.

* * * * *